US005560322A

United States Patent [19]

Fitzgerald

[11] Patent Number: 5,560,322

[45] Date of Patent: Oct. 1, 1996

[54] CONTINUOUS VERTICAL-TO-ANGULAR TUBE TRANSITIONS

[75] Inventor: Francis D. Fitzgerald, Phillipsburg, N.J.

[73] Assignee: Foster Wheeler Energy Corporation, Clinton, N.J.

[21] Appl. No.: 288,862

[22] Filed: Aug. 11, 1994

[51] Int. Cl.[6] ..... F22B 37/00

[52] U.S. Cl. ..... 122/6 A; 122/235.11; 122/235.14; 122/235.23; 122/510; 122/511

[58] Field of Search ..... 122/6 A, 235.11, 122/235.14, 235.23, 510, 511

[56] References Cited

U.S. PATENT DOCUMENTS 4,175,519 11/1979 Pratt et al. .
4,178,881 12/1979 Pratt et al. .
4,198,930 4/1980 Pratt et al. .
4,245,588 1/1981 Gil et al. .
4,331,105 5/1982 Kawamura et al. .
4,387,668 6/1983 Kochey, Jr. .
4,473,035 9/1984 Gorzegno .
4,782,793 11/1988 Salem .
4,864,973 9/1989 Lieb et al. .

*Primary Examiner*—Henry A. Bennett
*Assistant Examiner*—Siddmarth Ohri
*Attorney, Agent, or Firm*—Warren B. Kice; Haynes & Boone

[57] ABSTRACT

A steam generating system including an upright furnace section formed by a plurality of tubes, a portion of which have upper and lower tube ends and extend at an acute angle with respect to a horizontal plane, a portion of which extend vertically downwards from the lower tube ends, and a portion of which extend vertically upwards from the upper tube ends. Additional lower and upper vertical tubes are provided which are coplanar with, parallel to, and evenly distributed and interlaced among the tubes extending vertically from the respective lower and upper ends. Means is provided to pass fluid through the length of the furnace section to convert a portion of the fluid to steam or to heat the fluid, the fluid passing upwards first through the additional lower vertical tubes, then through the length of the angularly extending tubes including the vertical extensions thereof, and then through the additional upper vertical tubes.

38 Claims, 4 Drawing Sheets

CONTINUOUS VERTICAL-TO-ANGULAR TUBE TRANSITIONS

BACKGROUND OF THE INVENTION

This invention relates to a steam generating system and, more particularly, to a sub-critical or super-critical once-through steam generating system for converting water to steam.

In general, a once-through steam generator operates to circulate a pressurized fluid, usually water, through a steam generating section and a superheating section to convert the water to steam. In these arrangements, the water entering the unit passes once through the circuitry and discharges from the superheating section outlet of the unit as superheated steam for use in driving a turbine, or the like.

These arrangements provide several improvements over conventional drum-type boilers, and although some problems arose in connection with early versions of the once-through generators, such as excessive startup thermal losses, mismatching of steam temperature, the requirement for sophisticated controls and additional valving during startup, these problems have been virtually eliminated in later generating systems.

For example, the system disclosed in U.S. Pat. No. 4,099,384 and assigned to the assignee of the present application, includes a plurality of separators disposed in the main flow line between the steam generating section and the superheating section and adapted to receive fluid flow from the steam generating section during startup and full load operation of the system. This arrangement enables a quick and efficient startup to be achieved with a minimum of control functions, and with minimal need for costly valves. Also, the turbines can be smoothly loaded at optimum pressures and temperatures that can be constantly and gradually increased without the need of boiler division valves or external bypass circuitry for steam dumping. Also, according to this system, operation can be continuous at a very low load with a minimum of heat loss to the condenser.

In the latter arrangement, the walls of the furnace section of the generator are formed by a plurality of vertically extending tubes having fins extending outwardly from diametrically opposed portions thereof, with the fins of adjacent tubes being connected together to form a gas-fight structure. During startup, the furnace operates at constant pressure and super-critical water is passed through the furnace boundary walls in multiple passes to gradually increase its temperature. This requires the use of headers between the multiple passes to mix out heat unbalances caused by portions of the vertically extending tubes being closer to the burners than others or by the tubes receiving uneven absorption because of local slag coverage, burners being out of service, and other causes. The use of these intermediate headers, in addition to being expensive, makes it undesirable to operate the furnace at variable pressure because of probability of separation of the steam and liquid within the header and uneven distribution to the downstream circuit. Therefore, this type of arrangement requires a pressure reducing station interposed between the furnace outlet and the separators to reduce the pressure to predetermined values and, in addition, requires a relatively large number of downcomers to connect the various passes formed by the furnace boundary wall circuitry.

U.S. Pat. No. 4,178,881, also assigned to the present assignee discloses a steam generator which incorporates the features of the system discussed above and yet eliminates the need for intermediate headers, additional downcomers, and a pressure reducing station. Toward this end, the boundary walls of the furnace section of the latter steam generator are formed by a plurality of interconnected tubes, a portion of which extend at an acute angle with respect, to a horizontal plane. In this arrangement, the boundary walls defining the upper and lower portions of the furnace section of the steam generator are formed by vertical tube portions and the intermediate portion of the furnace section are formed by angular tube portions.

One geometric consequence of the angular tube arrangement is that, with reference to a horizontal plane, one angular tube generally occupies the space of two or three vertical tubes (depending on the angle of the angular tubes). Making the transition between the vertical and the angular tubes has typically been addressed using a bifurcated fitting (connecting one angular tube to two or three vertical tubes), an intermediate transition header, or a spiral-wound hopper (in the lower portion of the furnace).

Although these methods for making the transitions between the vertical and angular tube portions are effective, they have disadvantages relating to seals, two-phase flow distribution, thermo-hydraulic sensitivity, structural integrity, and thermal fatigue longevity in cycling service.

SUMMARY OF THE INVENTION

It is therefor an object of the present invention to provide a steam generator which incorporates all of the advantages of the angular tube arrangement discussed above.

It is a still further object of the present invention to provide a steam generator which resolves the above-mentioned problems relating to seals, two-phase flow distribution, thermo-hydraulic sensitivity, structural integrity, and thermal fatigue longevity in cycling service.

It is a still further object of the present invention to provide a steam generator having a furnace with walls comprising a plurality of tubes wherein each tube has an angular portion in an intermediate section of the furnace, and vertical portions in the lower and/or upper sections of the furnace, the vertical portions in both sections being continuous, smooth, extensions of the angular portions.

It is a still further object of the present invention to provide a steam generator which utilizes a first series of vertical tubes in the lower section of the furnace and a second series of tubes in the upper section of the furnace, wherein the first and second series of tubes are coplanar with, parallel to, and evenly distributed and interlaced among the vertical tubes extending from the angular tubes, and further wherein the first and second series of tubes have fluid communication with the vertical tubes extending from the angular tubes in the lower and upper sections of the furnace respectively.

Toward the fulfillment of these and other objects, the steam generator of the present invention comprises an upright furnace section having boundary walls apportioned among a lower section, an intermediate section, and an upper section. The walls comprise a first series of vertical tubes in the lower section, a second series of tubes having vertical portions in the lower and upper sections and an angular portion in the intermediate section, and a third series of vertical tubes in the upper section. The first and third series of tubes are, coplanar with, parallel to, and evenly distributed and interlaced among the corresponding vertical portions of tubes from the second series. The first series of tubes are connected to the second series of tubes, and the second series of tubes are connected to the, third series of tubes, so that fluid may be passed through the tubes to apply heat to the fluid.

BRIEF DESCRIPTION OF THE DRAWINGS

The above brief description, as well as further objects, features and advantages, of the present invention will be more fully appreciated by reference to the following detailed description of a presently preferred but nonetheless illustrative embodiment in accordance with the present invention, when taken in conjunction with the accompanying drawings, wherein.

DESCRIPTION OF THE PREFERRED EMBODIMENT

Figure 1:
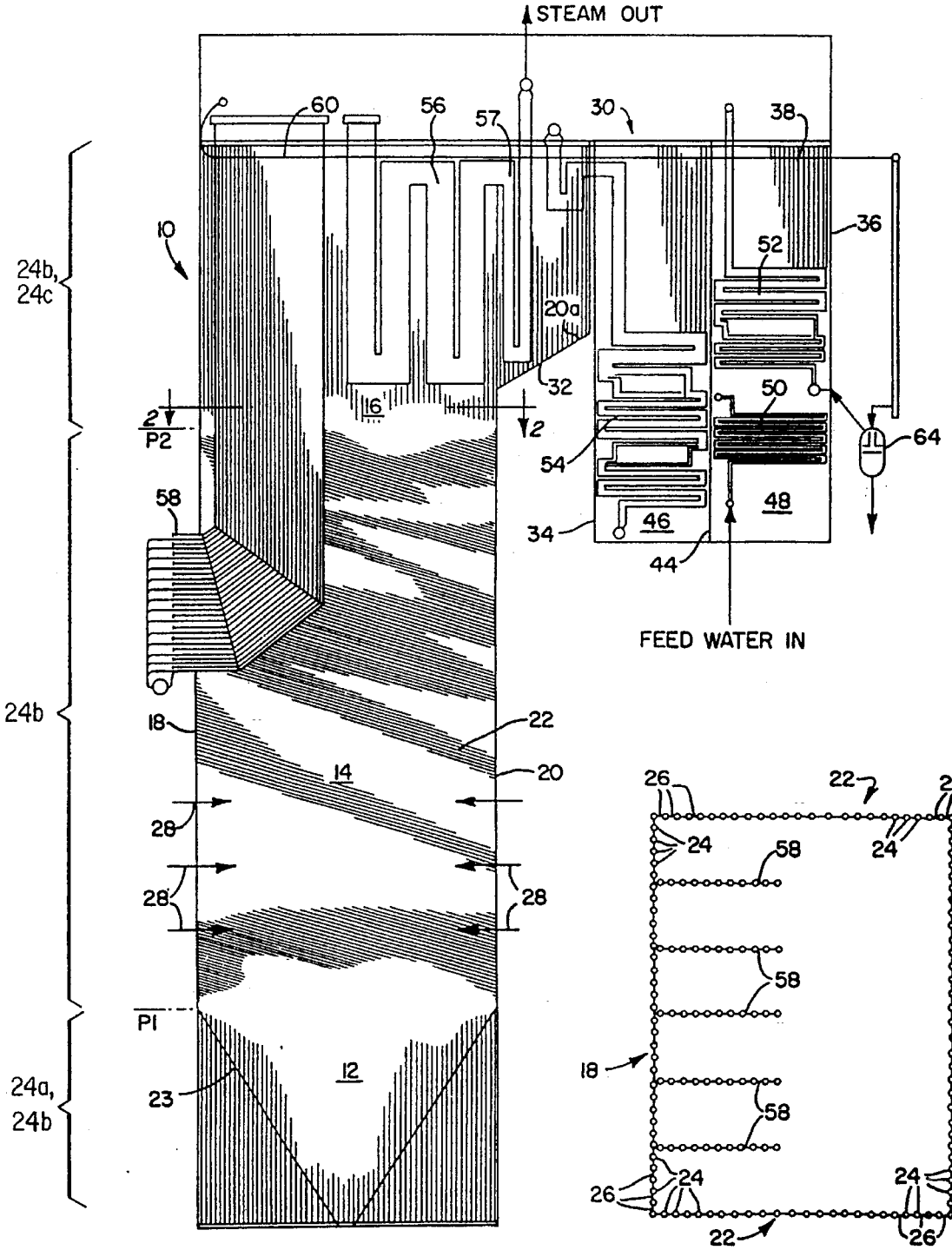
FIG. 1 is a schematic sectional view of the steam generator of the present invention.

Referring specifically to FIG. 1 of the drawings, the reference numeral 10 refers in general to a steam generator utilized in the system of the present invention and including a lower furnace section 12, an intermediate furnace section 14, and an upper furnace section 16. The boundary walls defining the furnace sections 12, 14 and 16 include a front wall 18, a rear wall 20, and two sidewalls extending between the front and rear wall, with one of the sidewalls being referred to by the reference numeral 22. The lower portions of the front wall 18 and the rear wall 20 are sloped inwardly to form a hopper section 23 at the lower furnace section 12 for the accumulation of ash, and the like, in a conventional manner.

Figure 2:
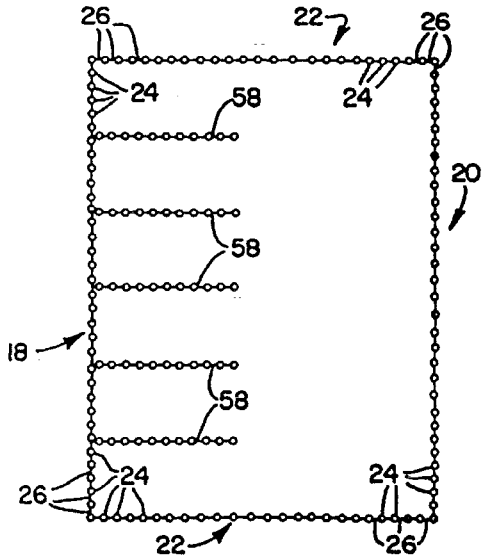
FIG. 2 is a sectional view taken along the line 2—2 of FIG. 1.

As shown in FIG. 2, each of the walls 18, 20 and 22 are formed of a plurality of tubes shown in general by the reference numeral 24 having continuous fins 26 extending outwardly from diametrically opposed portions thereof, with the fins of adjacent tubes being connected together to form a gas-tight structure. Although not shown in the drawings, it is understood that the outer portions of the walls 18, 20 and 22 are insulated and cased in a conventional manner.

Figure 3:
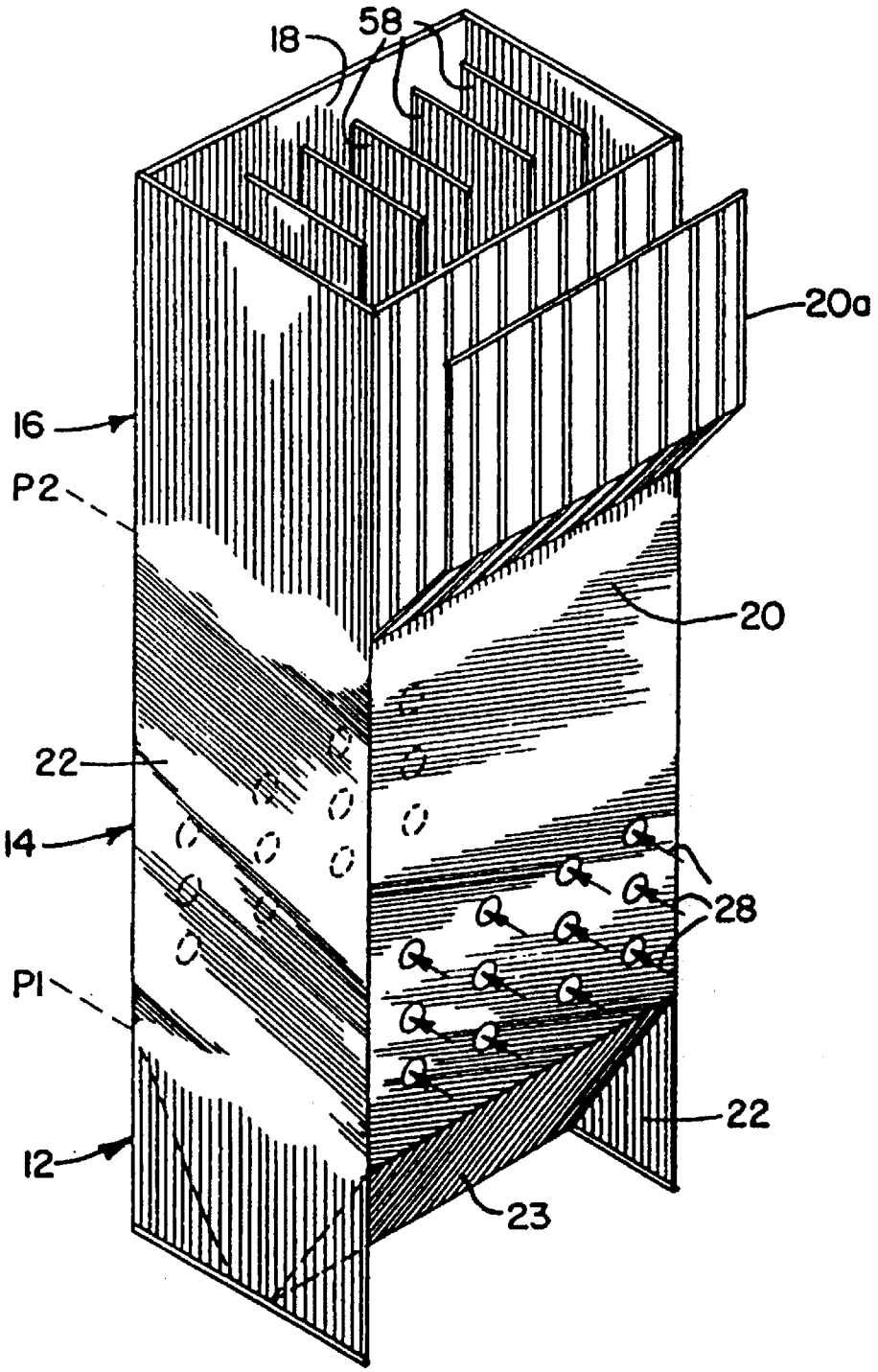
FIG. 3 is a partial perspective view of a portion of the steam generator of FIG. 1.

Referring to FIGS. 1–3, the tubes 24 include tubes 24*a* in the lower furnace section 12, tubes 24*b* which extend continuously through the furnace sections 12, 14, and 16, and tubes 24*c* in the upper furnace section 16. The tubes 24*a* and 24*b* forming the walls 18, 20 and 22 of the lower furnace section 12 extend vertically to a horizontal plane P1 located at the upper portion of the hopper section 23. The tubes 24*b* forming the walls 18, 20 and 22 in the intermediate section 14 extend from the plane P1 to a plane P2 disposed in the upper portion of the steam generator 10, with these tubes extending at an acute angle with respect to the planes P1 and P2. The tubes 24*b* and 24*c* forming the walls 18, 20 and 22 of the upper furnace section 16 extend vertically from the plane P2 to the top of the latter section. It can be appreciated that each of the tubes 24*b* extend for the entire length of the furnace and have two vertical portions, an angular portion, and two bend portions. The tubes 24*b* in the intermediate section 14 extend from the plane P1 and wrap around the perimeter of the furnace to form the walls 18, 20 and 22 before they terminate at the plane P2. The tubes 24*b* in the intermediate section 14 also have a plurality of the fins 26 which are arranged and which function in an identical manner to the fins of the tubes in the lower furnace section 12 and in the upper furnace section 14.

As will be described in detail later, in the lower furnace section 12, the upper ends of the vertical tubes 24*a* have fluid communication with the lower ends of the tubes 24*b*. In a similar manner, the upper ends of the tubes 24*b* have fluid communication with the lower ends of tubes 24*c*.

As also shown in FIGS. 1–3, the upper portion of the rear wall 20 in the upper section 16 has a branch wall 20*a* which is formed by bending a selected number of tubes 24*b* and 24*c* from the rear wall 20 outwardly in a manner to define spaces between the remaining tubes 24*b* and 24*c* in the wall 20 and between the tubes forming the branch wall 20*a* to permit combustion gases to exit from the upper furnace section 16, as will be described later.

A plurality of burners 28 are disposed in the front and rear walls 18 and 20 in the intermediate furnace section 14, with the burners being arranged in this example in three vertical rows of four burners per row. The burners 28 are shown :schematically since they can be of a conventional design.

A vestibule-convection area, shown in general by the reference numeral 30, is provided in gas flow communication with the upper furnace section 16 and includes a vestibule floor 32 defined in part by portions of the tubes 24*b* and 24*c* forming the branch wall 20*a*. It is understood that the vestibule floor 32 is rendered gas-tight. The convection area 30 includes a front wall 34, a rear wall 36, and two sidewalls 38 (with one of the latter being shown in FIG. 1) formed of a plurality of vertically extending tubes 24 having fins 26 connected in the manner described above.

A partition wall 44, also formed by a plurality of interconnected tubes 24, is provided in the vestibule-convection area 30 to divide the latter into a front gas pass 46 and a rear gas pass 48. An economizer 50 is disposed in the lower portion of the rear gas pass 48, a primary superheater 52 is disposed immediately above the economizer, and a bank of reheater tubes 54 is provided in the front gas pass 46.

A platen superheater 56 is provided in the upper furnace section 16 and a finishing superheater 57 is provided in the vestibule portion of the heat recovery area 30 in direct fluid communication with the platen superheater 56.

A plurality of division walls 58 are provided with each having a portion disposed adjacent the front wall 18. The division walls 58 penetrate a portion of the tubes 24 of the latter wall in the intermediate furnace section 14, and extend upwardly within the upper furnace section 16 as shown in FIGS. 1 and 3. These walls 58 may also be arranged as non-drainable pendant platens in the upper furnace section 16.

The upper end portions of the walls 18, 20 and 22, the branch wall 20*a*, and the division walls 58, as well as the partition wall 44, sidewalls 38, front wall 34, and rear wall 36 of the vestibule-convection area 30, all terminate in substantially the same general area in the upper portion of the steam generating section 10.

A roof 60 is disposed in the upper portion of the section 10 and consists of a plurality of tubes 24 having fins 26 connected in the manner described above, but extending horizontally from the front wall 18 of the furnace section to the rear wall 36 of the vestibule-convection area 30.

It can be appreciated from the foregoing that combustion gases from the burners 28 in the intermediate furnace section 14 passes upwardly to the upper furnace section 16 and through the vestibule-convection area 30 before exiting from the front gas pass 46 and the rear gas pass 48. As a result, the hot gases pass over the platen superheater 56, the finishing superheater 57 and the primary superheater 52, as well as the reheater tubes 54 and the economizer 50, to add heat to the fluid flowing through these circuits.

A plurality of separators 64, disposed in a parallel relationship adjacent the rear wall 36 of the vestibule-convection area 30, are installed directly in the main flow circuit between the roof 60 and the primary superheater 52. The separators 64 may be identical to those described in the above-mentioned patent and operate to separate the two-phase fluid exiting from the roof 60 into a liquid and steam. The steam from the separators 64 is passed directly to the primary superheater 52 and the liquid is passed to a drain manifold and heat recovery circuitry for further treatment as also disclosed in the above-mentioned patent.

Figure 4:
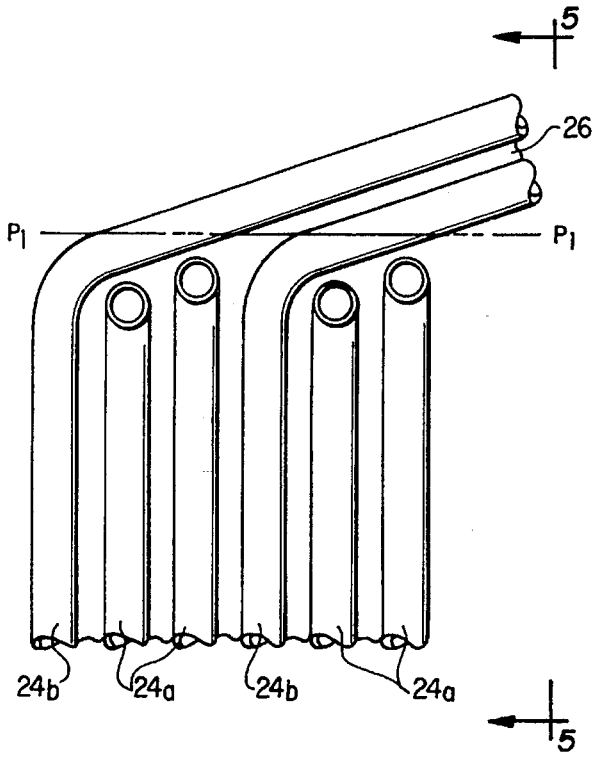
FIG. 4 is an enlarged, partial, front elevational view of the tubes disposed between the lower and intermediate sections of a boundary wall of FIG. 1.
Figure 5:
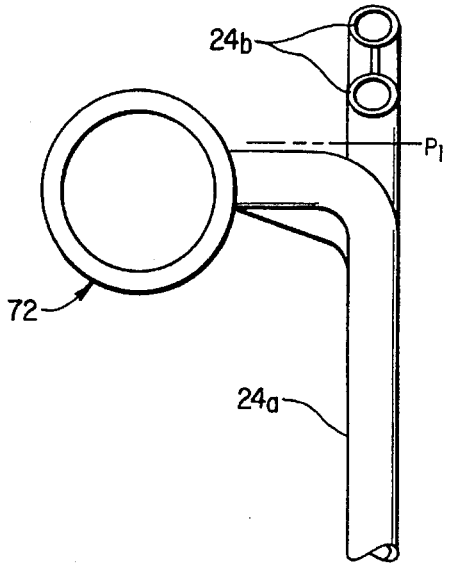
FIG. 5 is a view taken along the line 5—5 of FIG. 4.

As more clearly illustrated in FIGS. 4 and 5, which depict a portion of the wall 22 of the lower furnace section 12, the tubes 24*a* and 24*b* are substantially parallel and coplanar, with the tubes 24*b* interspersed between and evenly distributed among the tubes 24*a*. In the present embodiment, for example, there is one tube 24*b* for every two tubes 24*a*. Referring to FIG. 4, the tubes 24*b* are bent proximate to the horizontal plane P1 from a vertical orientation below the plane P1 to an angular orientation above the plane P1. The angular extension of the tubes 24*b* form the walls 18, 20, and 22 of the intermediate furnace section 14. Referring to FIG. 5, the upper ends of the tubes 24*a* are bent out of the wall 22 and are connected to a horizontal header 72 such that fluid communication is established therebetween.

Figure 6:
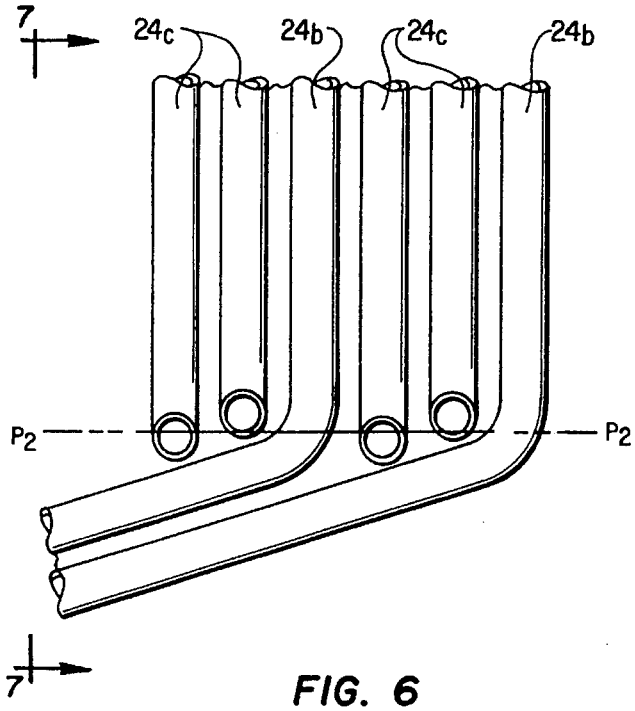
FIG. 6 is an enlarged, partial, front elevational view of the tubes disposed between the intermediate and upper sections of a boundary wall of FIG. 1.
Figure 7:
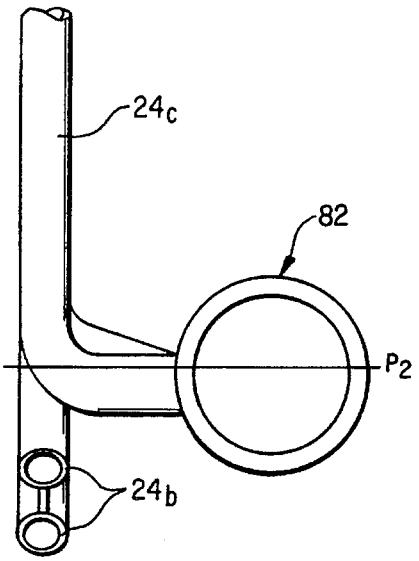
FIG. 7 is a view taken along the line 7—7 of FIG. 6.

FIGS. 6 and 7 depict a portion of the wall 22 of the upper furnace section 16. The tubes 24*b* are substantially parallel and coplanar with, interspersed between, and evenly distributed among the tubes 24*c*. In the present embodiment, for example, there is one tube 24*b* for every two tubes 24*c*. Referring to FIG. 6, the tubes 24*b* are bent proximate to the horizontal plane P2 from an angular orientation below the plane P2 (as described in connection with FIGS. 4 and 5) to a vertical orientation above the plane P2. The vertical extension of the tubes 24*b* above the plane P2 forms the walls 18, 20, and 22 of the upper furnace section 16. Referring to FIG. 7, the lower ends of the tubes 24*c* are bent out of the wall 22 and are connected to a horizontal header 82 such that fluid communication is established therebetween.

Figure 8:
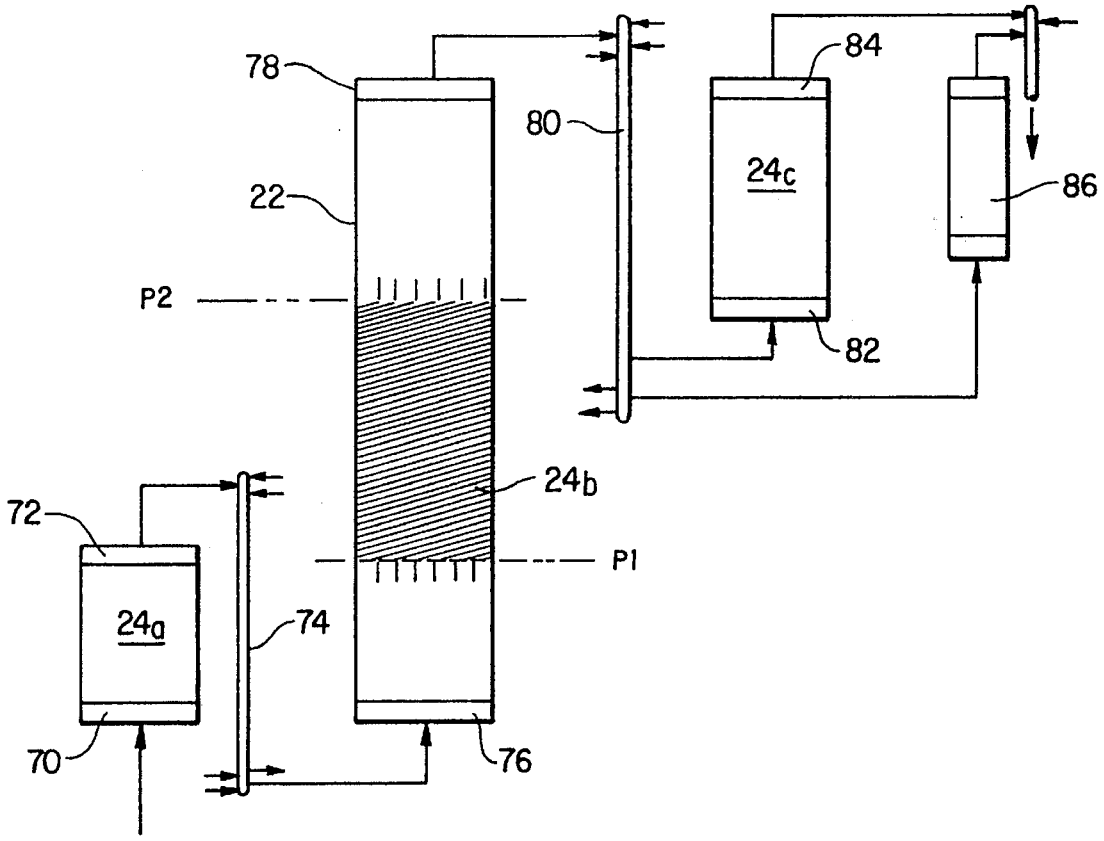
FIG. 8 is a schematic view of the fluid flow circuit through a boundary wall of the furnace section of the steam generator of FIG. 1.

Referring to FIG. 8, which depicts a sidewall 22 of the steam generator of the present invention, a fluid flow circuit is established from the lower ends of the tubes 24*a* to the upper ends of the tubes 24*c*. To this end, additional horizontal headers are provided, including an inlet header 70 having fluid communication with the lower ends of the tubes 24*a*, an inlet header 76 having fluid communication with the lower ends of the tubes 24*b*, an outlet header 78 having fluid communication with the upper ends of the tubes 24*b*, and an outlet header 84 having fluid communication with the upper ends of the tubes 24*c*. Although not shown in the drawings, it is understood that the lower ends of the tubes 24*a* and the upper ends of the tubes 24*c* are bent out of the sidewall 22, in a similar manner as the opposing ends of the same tubes, as described above, so that headers 70 and 84, like headers 72 and 82, are disposed outside the sidewall 22. A vertical downcomer 74, disposed outside the sidewall 22, provides fluid communication between the upper ends of the tubes 24*a* and the lower ends of the tubes 24*b*; similarly, a vertical downcomer 80, also disposed outside the sidewall 22, provides fluid communication between the upper ends of the tubes 24*b* and the lower ends of the tubes 24*c*.

It can be appreciated that the sequence of fluid flow in the sidewall 22 is through the inlet headers 70, the tubes 24*a*, the outlet headers 72, the downcomers 74, the inlet headers 76, the tubes 24*b*, the outlet headers 78, the downcomers 80, the inlet headers 82, the tubes 24*c*, and the outlet headers 84. It can be further appreciated that fluid makes two passes in the lower furnace section 12 and in the upper furnace section 16. Although the above circuit is shown in FIG. 8 only in connection with one sidewall 22, it is understood that the circuit is identical with respect to the front wall 18, the rear wall 20, and the other sidewall 22, with the exception, of course, that the tubes 24*a* and 24*b* in the walls 18 and 20 of the lower furnace section 12 slope inwardly to form the hopper section 23.

Although not shown in the drawings for clarity of presentation, it is understood that suitable inlet and outlet headers, downcomers and conduits, in addition to those described above, are provided to place the tubes 24 of each of the aforementioned walls and heat exchangers as well as the roof 60 in fluid communication to establish a flow circuit that will be described in detail below.

With reference to FIG. 1, in operation, feedwater from an external source is passed through the economizer tubes 50 to raise the temperature of the water before it is passed to the inlet headers 70 (FIG. 8) provided at the lower portions of the furnace walls 18, 20 and 22. All of the water flows upwardly and simultaneously through the walls 18, 20, and 22, and, as shown more particularly in FIG. 8, the tubes 24*a*, 24*b*, and 24*c* forming the walls, to raise the temperature of the water further to convert at least a portion of same to steam, before it is collected in the headers 84 (FIG. 8) located at the upper portion of the steam generator 10. The fluid temperature differential between adjacent vertical tubes in the furnace should be maintained at less than 100 degrees F. The fluid is then passed downwardly through a suitable downcomer, or the like (not shown) and then upwardly through the division walls 58 (FIG. 2) to add additional heat to the fluid. The fluid is then directed through the walls 34, 36, 38 and 44 of the vestibule-convection area 30 after which it is collected and passed through the roof 60. From the roof 60, the fluid is passed via suitable collection headers, or the like, to the separators 64 which separate the steam portion of the fluid from the liquid portion thereof. The liquid portion is passed from the separators to a drain manifold and heat recovery circuitry (not shown) for further treatment, and the steam portion of the fluid in the separators 64 is passed directly into the primary superheater 52. From the latter, the fluid is spray attemperated after which it is passed to the platen superheater 56 and the finishing superheater 57 before it is passed in a dry steam state to a turbine or the like.

Several advantages result from the foregoing. For example, the use of the angular tubes which wrap around to form the intermediate furnace section 14 enables the fluid to average out furnace heat unbalances and be passed through the boundary walls 18, 20 and 22 of the furnace section in one complete pass, thus eliminating the use of multiple passes and their associated intermediate headers and downcomers. Also, as a result of the angular tubes, a relatively high mass flow rate and large tube size can be utilized over that possible with vertical tube arrangements.

Further advantages result from using the transition described herein between the vertical and angular portions of tubes 24*b*. For example, in comparison to bifurcated fittings, structural integrity and thermal fatigue longevity in cycling service is enhanced. Two-phase flow is also eliminated or more evenly distributed. As a result of reduced overall thermal duty of the tubes 24*b*, the output enthalpy unbalance is reduced at all loads of the tubes 24*b*. The subcooling at the inlet of the tubes 24*b* is reduced, resulting in improved thermo-hydraulic sensitivity of the tubes 24*b* during subcritical pressure operations. The mass flow rate of fluid in the tubes in the lower furnace section 12 may be 50% more than the flow rate attained using bifurcated fittings or an intermediate header. The heat absorption unbalance at the inlet to the tubes 24*b* in the hopper section 23 resulting from the inwardly sloped walls 18 and 20 absorbing more heat than the sidewalls 22 may be as little as one-third the unbalance resulting when bifurcated fittings or intermediate headers are used. If discrete bend elements are used between vertical and angular portions of the tubes 24*b*, then a welded seal may be used instead of a refractory seal.

It is understood that while the preferred embodiment described above includes a furnace having a substantially rectangular shaped cross-sectional area, other cross-sectional configurations, such as those having a circular or elliptical pattern, may be utilized as long as the angular tube arrangement is maintained. For example, the furnace may have a helical configuration in a pattern conforming to the cross-sectional shape of the furnace. (In this context, it should be noted that the type of boiler covered by the present invention in which the tubes are angularly arranged in the furnace boundary wall is commonly referred to by those skilled in the art as a "helical tube boiler", notwithstanding the fact that a true mathematical helix is not generated in a boiler which has a substantially rectangular cross-sectional area.)

It is also understood that the tubes 24*b* may wrap around the furnace short of a complete revolution or for more than one complete revolution, depending on the overall physical dimensions of the furnace. The angular tubes 24*b* may be inclined at various angles with reference to a horizontal plane and there may be one or more vertical tubes 24*a* and 24*c* for each of the tubes 24*b*. The tubes 24*b* may also utilize discrete bend elements between vertical and angular tube portions, and the inlet and outlet diameters of the bend elements may be different. The tubes 24*b* may have a smooth bore or a rifled bore and further, may utilize multi-lead ribs or internal ribbon turbulators.

Referring again to FIG. 8, it is further understood that the downcomer 80 may be connected to a short aperture sidewall buffer 86 in a heat recovery area so as to provide fluid communication between the upper ends of the angular tubes 24*b* and the buffer. Fluid may then be passed from the upper ends of the tubes 24*b* for use in a heat recovery area buffer circuit, thus reducing the thermal stress at the weld interface between the aperture/heat recovery area and the furnace enclosure wall.

It is further understood that portions of the steam generator have been omitted for the convenience of presentation. For example, support systems can be provided that extend around the boundary walls of the steam generator and a windbox or the like may be provided around the burners 28 to supply air to same in a conventional manner. It is also understood that the upper end portions of the tubes 24 forming the upper furnace section 16 and vestibule-convection area 30 can be hung from a location above the steam generating section 10 to accommodate top support and thermal expansion in a conventional manner.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention therein.

What is claimed is:

1. A steam generator system comprising:

a first series of tubes extending substantially vertically to form a portion of a lower wall of a furnace;

a second series of tubes extending substantially vertically to form a portion of an upper wall of said furnace;

a third series of tubes extending substantially vertically in said lower wall to form a portion of said lower wall, substantially angularly to form an intermediate wall of said furnace, and substantially vertically in said upper wall to form a portion of said upper wall; said third series of tubes being in a substantially interlaced, coplanar and parallel relationship with said first series of tubes in said lower wall and with said second series of tubes in said upper wall;

means for passing fluid through said tubes to apply heat to said fluid;

a superheating section, fluid separating means for receiving fluid from said furnace during startup and full load operation of said system and separating said fluid into a liquid and a vapor; and fluid flow circuitry for passing the vapor from said fluid separating means to said superheating section during startup and full load operation of said system.

2. The steam generator of claim 1 further comprising a plurality of fins extending between adjacent tubes to render said furnace gas-tight.

3. The steam generator of claim 1 wherein each of said tubes in said third portion of tubes forms substantially a single, continuous fluid flow passage.

4. The steam generator of claim 1 wherein each of said third portion of tubes includes a first single-passage bend portion between said lower and said intermediate wall portions, and a second single-passage bend portion between said intermediate and said upper wall portions.

5. The steam generator of claim 1 further comprising a heat recovery area having a short aperture sidewall buffer, said buffer having fluid communication with said third portion of tubes.

6. A steam generator system comprising:

a first series of tubes extending substantially vertically to form a portion of a lower wall of a furnace;

a second series of tubes extending substantially vertically to form a portion of an upper wall of said furnace;

a third series of tubes extending substantially vertically in said lower wall to form a portion of said lower wall, substantially angularly to form an intermediate wall of said furnace, and substantially vertically in said upper wall to form a portion of said upper wall; said third series of tubes being in a substantially interlaced, coplanar and parallel relationship with said first series of tubes in said lower wall and with said second series of tubes in said upper wall;

means for passing fluid through said tubes to apply heat to said fluid; and a heat recovery area having a short aperture sidewall buffer in fluid communication with said third series of tubes.

7. The steam generator of claim 6 further comprising a plurality of fins extending between adjacent tubes to render said furnace gas-tight.

8. The steam generator of claim 6 wherein each of said tubes in said third portion of tubes forms substantially a single, continuous fluid flow passage.

9. The steam generator of claim 6 wherein each of said third portion of tubes includes a first single-passage bend portion between said lower and said intermediate wall portions, and a second single-passage bend portion between said intermediate and said upper wall portions.

10. A steam generator system comprising:

an upright furnace section having boundary walls formed by a plurality of tubes;

a first series of said tubes extending substantially vertically in the lower portion of said walls;

a second series of said tubes extending substantially vertically in the upper portion of said walls;

a third series of said tubes extending substantially vertically in said lower wall portion, substantially angularly in the intermediate portion of said walls, and substantially vertically in said upper wall portion; said third series of tubes being in a substantially interlaced, coplanar, and parallel relationship with said first series of tubes in said lower wall portion and with said second series of tubes in said upper wall portion;

means for passing fluid through said tubes to apply heat generated in said furnace to said fluid;

a superheating section, fluid separating means for receiving fluid from said furnace during startup and full load operation of said system and separating said fluid into a liquid and a vapor; and fluid flow circuitry for passing the vapor from said fluid separating means to said superheating section during startup and full load operation of said system.

11. The steam generator of claim 10 further comprising a plurality of fins extending between adjacent tubes to render said furnace gas-tight.

12. The steam generator of claim 10 wherein each of said tubes in said third portion of tubes forms substantially a single, continuous fluid flow passage.

13. The steam generator of claim 10 wherein each of said third portion of tubes includes a first single-passage bend portion between said lower and said intermediate wall portions, and a second single-passage bend portion between said intermediate and said upper wall portions.

14. The steam generator of claim 10 further comprising a heat recovery area having a short aperture sidewall buffer, said buffer having fluid communication with said third portion of tubes.

15. A steam generator system comprising:

an upright furnace section having boundary walls formed by a plurality of tubes;

a first series of said tubes extending substantially vertically in the lower portion of said walls;

a second series of said tubes extending substantially vertically in the upper portion of said walls;

a third series of said tubes extending substantially vertically in said lower wall portion, substantially angularly in the intermediate portion of said walls, and substantially vertically in said upper wall portion; said third series of tubes being in a substantially interlaced, coplanar, and parallel relationship with said first series of tubes in said lower wall portion and with said second series of tubes in said upper wall portion;

means for passing fluid through said tubes to apply heat generated in said furnace to said fluid; and a heat recovery area having a short aperture sidewall buffer for receiving fluid from said third series of tubes.

16. The steam generator of claim 15 further comprising a plurality of fins extending between adjacent tubes to render said furnace gas-tight.

17. The steam generator of claim 15 wherein each of said tubes in said third portion of tubes forms substantially a single, continuous fluid flow passage.

18. The steam generator of claim 15 wherein each of said third portion of tubes includes a first single-passage bend portion between said lower and said intermediate wall portions, and a second single-passage bend portion between said intermediate and said upper wall portions.

19. A steam generator system comprising:

an upright furnace section having boundary walls formed by a plurality of tubes, said walls being arranged into a lower section, an intermediate section, and an upper section, said plurality of tubes being apportioned into a first series of tubes, a second series of tubes, and a third series of tubes, said first and third series of tubes extending substantially vertically, each of said tubes in said second series of tubes having, in adjoining order, a first portion extending substantially vertically, a first bend portion, a portion extending at an acute angle with reference to a horizontal plane, a second bend portion, and a second portion extending substantially vertically, each of said tubes in said second series of tubes thus forming substantially a single, continuous, smooth, fluid flow passage extending the entire length of said furnace section, said lower section of said walls comprising said first series of said tubes extending in a substantially interlaced, coplanar, parallel relationship with said first vertical portions of said second series of said tubes, said intermediate section of said walls comprising said angular portions of said second series of said tubes, and said upper section of said walls comprising said third series of said tubes extending in a substantially interlaced, coplanar, parallel relationship with said second vertical portions of said second series of said tubes;

means for passing fluid through said first series of said tubes, then through said second series of said tubes, and then through said third series of said tubes;

a superheating section, fluid separating means for receiving fluid from said furnace during startup and full load operation of said system and separating said fluid into a liquid and a vapor; and fluid flow circuitry for passing the vapor from said fluid separating means to said superheating section during startup and full load operation of said system; and a heat recovery area having a short aperture sidewall buffer, said buffer receiving fluid from said second series of tubes.

20. The steam generator of claim 19 further comprising a plurality of fins extending between adjacent tubes to render said furnace gas-fight.

21. The steam generator of claim 19 wherein each of said tubes in said third portion of tubes forms substantially a single, continuous fluid flow passage.

22. The steam generator of claim 19 wherein each of said third portion of tubes includes a first single-passage bend portion between said lower and said intermediate wall portions, and a second single-passage bend portion between said intermediate and said upper wall portions.

23. The steam generator of claim 19 further comprising a heat recovery area having a short aperture sidewall buffer, said buffer having fluid communication with said third portion of tubes.

24. A steam generator system comprising:

a first series of tubes extending substantially vertically to form a portion of at least one lower wall of a furnace;

a second series of tubes extending substantially vertically to form a portion of at least one upper wall of said furnace;

a third series of tubes extending substantially vertically in said lower wall and said upper wall to respectively form the remaining portions of said lower wall and said upper wall, said third series of tubes extending substantially angularly between their respective vertically-extending portions to form an intermediate wall of said furnace;

means for passing fluid through said tubes to apply heat to said fluid;

a superheating section;

fluid separating means for receiving fluid from said furnace during startup and full load operation of said system and separating said fluid into a liquid and a vapor, and fluid flow circuitry for passing the vapor from said fluid separating means to said superheating section during startup and full load operation of said system.

25. The steam generator of claim 24 further comprising a plurality of fins extending between adjacent tubes to render said furnace gas-tight.

26. The steam generator of claim 24 wherein each of said tubes in said third portion of tubes forms substantially a single, continuous fluid flow passage.

27. The steam generator of claim 24 wherein each of said third portion of tubes includes a first single-passage bend portion between said lower and said intermediate wall portions, and a second single-passage bend portion between said intermediate and said upper wall portions.

28. The steam generator of claim 24 further comprising a heat recovery area having a short aperture sidewall buffer, said buffer having fluid communication with said third portion of tubes.

29. A steam generator system comprising:

a first series of tubes extending substantially vertically to form a portion of at least one lower wall of a furnace;

a second series of tubes extending substantially vertically to form a portion of at least one upper wall of said furnace;

a third series of tubes extending substantially vertically in said lower wall and said upper wall to respectively form the remaining portions of said lower wall and said upper wall, said third series of tubes extending substantially angularly between their respective vertically-extending portions to form an intermediate wall of said furnace;

means for passing fluid through said tubes to apply heat to said fluid; and a heat recovery area having a short aperture sidewall buffer in fluid communication with said third series of tubes.

30. The steam generator of claim 29 further comprising a plurality of fins extending between adjacent tubes to render said furnace gas-tight.

31. The steam generator of claim 29 wherein each of said tubes in said third portion of tubes forms substantially a single, continuous fluid flow passage.

32. The steam generator of claim 29 wherein each of said third portion of tubes includes a first single-passage bend portion between said lower and said intermediate wall portions, and a second single-passage bend portion between said intermediate and said upper wall portions.

33. A steam generator system having a furnace, said system comprising:

a plurality of tubes forming a wall of said furnace and each extending continuously for substantially the entire length of said wall, each tube extending substantially vertically in the lower portion of said wall, substantially angularly in the intermediate portion of said wall, and substantially vertically in the lower portion of said wall; and means for passing fluid through said tubes to apply heat to said fluid.

34. The system of claim 33 further comprising additional tubes disposed in said lower wall portion and said upper wall portion, said additional tubes extending vertically and in a substantially coplanar and parallel relationship with said first-mentioned tubes intermediate wall.

35. The steam generator of claim 33 further comprising a plurality of fins extending between adjacent tubes to render said furnace gas-tight.

36. The steam generator of claim 33 wherein each of said tubes in said third portion of tubes forms substantially a single, continuous, fluid flow passage.

37. The steam generator of claim 33 wherein each of said third portion of tubes includes a first single-passage bend portion between said lower and said intermediate wall portions, and a second single-passage bend portion between said intermediate and said upper wall portions.

38. The steam generator of claim 33 further comprising a heat recovery area having a short aperture sidewall buffer, said buffer having fluid communication with said third portion of tubes.

* * * * *

UNITED STATES PATENT AND TRADEMARK OFFICE

CERTIFICATE OF CORRECTION

PATENT NO. : 5,560,322

DATED : October 1, 1996

INVENTOR(S) : Francis D. Fitzgerald

It is certified that error appears in the above-indentified patent and that said Letters Patent is hereby corrected as shown below:

Col. 2, line 5, after "respect" delete the comma.

Col. 2, line 64, after "are" delete the comma.

In the Claims:

Col. 12, line 41, after "tubes", delete "intermediate wall" .

Signed and Sealed this

Twentieth Day of May, 1997

*Attest:*

Bruce Lehman

BRUCE LEHMAN

*Attesting Officer*

*Commissioner of Patents and Trademarks*